US005167282A

United States Patent [19]

Schneider et al.

[11] Patent Number: 5,167,282

[45] Date of Patent: Dec. 1, 1992

[54] APPARATUS AND METHOD FOR DETONATING WELL PERFORATORS

[75] Inventors: John L. Schneider, Skene; Hugo M. Barcia; Bruce Robinson, both of Aberdeen; Leslie E. Jordan, Inverurie, all of United Kingdom

[73] Assignee: Phoenix Petroleum Services Ltd., Inverurie, United Kingdom

[21] Appl. No.: 860,562

[22] Filed: Mar. 30, 1992

Related U.S. Application Data

[63] Continuation-in-part of Ser. No. 635,597, filed as PCT/GB89/00831, Jul. 19, 1989, abandoned.

[30] Foreign Application Priority Data

Jul. 19, 1988 [GB] United Kingdom ..... 8817178

[51] Int. Cl.[5] ..... E21B 43/116

[52] U.S. Cl. ..... 166/297; 175/4.54; 175/4.56

[58] Field of Search ..... 166/297, 55; 175/4.54, 175/4.56; 89/1.15; 102/313

[56] References Cited

U.S. PATENT DOCUMENTS

| | | | |
|---|---|---|---|
| 4,629,001 | 12/1986 | Miller et al. | 166/297 |
| 4,650,010 | 3/1987 | George et al. | 175/4.54 X |
| 4,678,044 | 7/1987 | Luke et al. | 175/4.54 X |
| 4,770,246 | 9/1988 | Ward | 175/4.54 X |
| 4,924,952 | 5/1990 | Schneider | 175/4.54 |

FOREIGN PATENT DOCUMENTS

| | | | |
|---|---|---|---|
| 0184377 | 6/1986 | European Pat. Off. . | |
| 2194316 | 3/1988 | United Kingdom | 175/4.54 |

*Primary Examiner*—William P. Neuder
*Attorney, Agent, or Firm*—Florence U. Reynolds

[57] ABSTRACT

A pressure-actuated head for detonating a gun for perforating a well bore is suspended on a tubing string for lowering down the well. The head includes a detonator pin biased towards a detonator but restrained until detonation is required. Detonation is effected by causing or allowing a pressure differential to develop across a piston. Fluid communication between chambers on respective sides of the piston is via a pressure control system which allows the pressure differential to develop over a period of time.

20 Claims, 3 Drawing Sheets

APPARATUS AND METHOD FOR DETONATING WELL PERFORATORS

This application is a continuation-in-part application of application Ser. No. 07/635,597, filed as PCT/GB89/00831, Jul. 19, 1989, now abandoned.

BACKGROUND OF THE INVENTION

This invention relates to detonating apparatus for detonating guns, particularly tubing conveyed perforating guns, for explosively perforating the well-bore casing, or perforating guns lowered on a slick line for perforating the tubing string or drill pipe string of wells such as, for example, oil, gas, water and steam wells.

Perforating guns containing explosive charges are frequently positioned within the casing or string of oil wells and left there, at great depth, until it is required to perforate the casing or string. While the guns are in situ, it is important that they are not inadvertently detonated due to spurious electrical signals, short pressure surges, the changes in pressure as the gun is moved down or up the well, or indeed any pressure changes caused by means other than those required to actuate the detonating apparatus.

It is an object of the present invention to avoid such difficulties.

SUMMARY OF THE INVENTION

According to one aspect of the present invention, there is provided detonating apparatus for detonating a gun for perforating a well bore casing or string, the apparatus being for suspension on a tubing string lowered down the well and comprising a detonating pin biased towards a detonator, restraining means for restraining the pin from movement until detonation is required, and pressure-actuated release means comprising displaceable means arranged for displacement to release the restraining means under the influence of a predetermined differential fluid pressure, and pressure control means for causing or allowing said differential pressure to develop over a period of time.

Preferably the displaceable means are fixed against movement by shear means, which are sheared when detonation is required by shear forces generated when said predetermined pressure is reached. A spring or other energy storage means may be provided to assist subsequent movement of said means to a position in which the retaining means are released.

The displaceable means may be connected to a piston rod of a piston and cylinder assembly, the piston having first and second fluid reservoirs on respective sides thereof within the cylinder, and movement of the piston being caused by achievement of said differential pressure between the reservoirs.

Conveniently, the pressure control means are located to allow fluid in the second reservoir to bleed through a restrictor orifice into a third, variable-volume reservoir.

Preferably, again, the first and second reservoirs are connected by a smaller restrictor orifice which allows fluid to flow from the second reservoir into the first reservoir to allow it to be pressurized, and to flow from the first to the second reservoir while fluid is flowing from the second to the third reservoir, but at a slower rate than the rate of flow from the second to third reservoir.

According to another aspect of the invention, a method of actuating detonating apparatus of the above-mentioned kind, comprises allowing the fluid pressure in the first and second reservoirs to equal well bore pressure, isolating the well bore from the tubing string and reducing the pressure of the fluid in the tubing string until actuation has occurred.

According to a further aspect of the invention, a method of actuating detonating apparatus of the above-mentioned kind comprises isolating the well bore from the tubing string, increasing the pressure in the tubing string above well bore pressure, allowing the pressure in the first and second reservoirs to reach the increased value, and then reducing the pressure in the tubing string until the actuation has occurred.

BRIEF DESCRIPTION OF THE DRAWINGS

Two embodiments of the invention are described, by way of example only, with reference to the accompanying drawings, in which FIGS. 1, 2 and 3 are sections through a plane including the longitudinal axis of successive lengths of detonating apparatus, according to the invention, for detonating tubing conveyed perforating guns and in which

DESCRIPTION OF THE PREFERRED EMBODIMENTS

Figure 1:
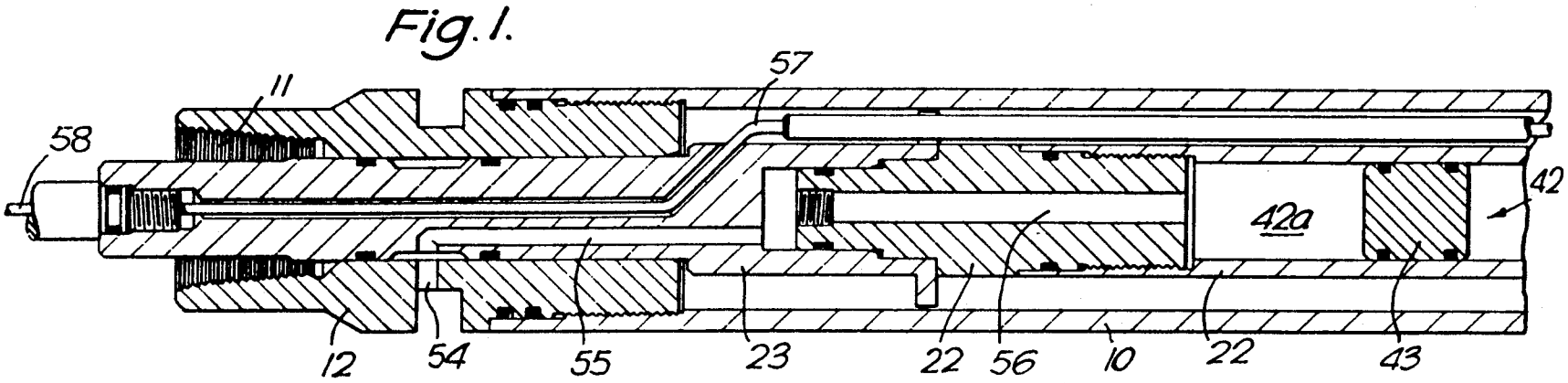
Figure 2:
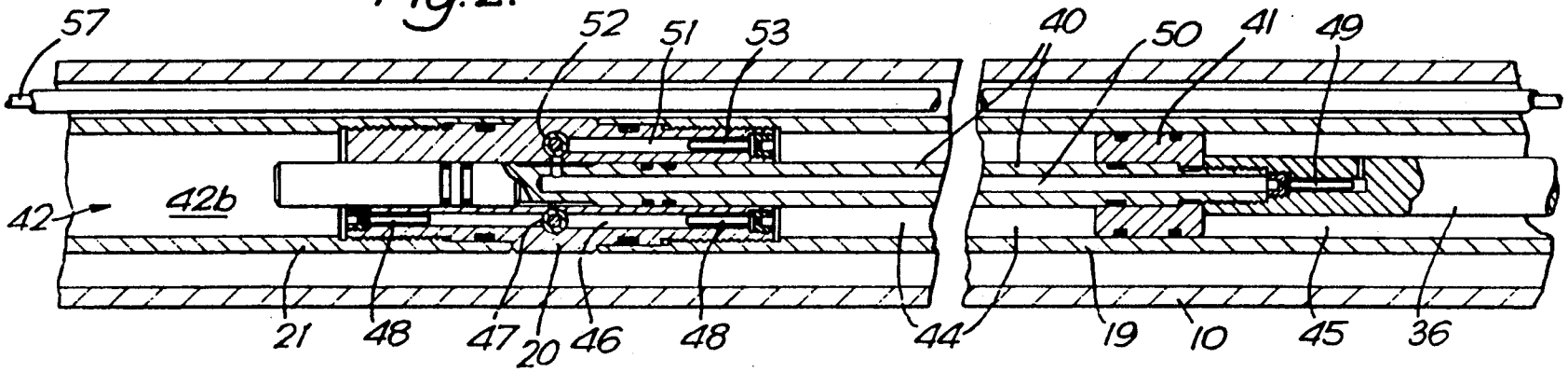
Figure 3:
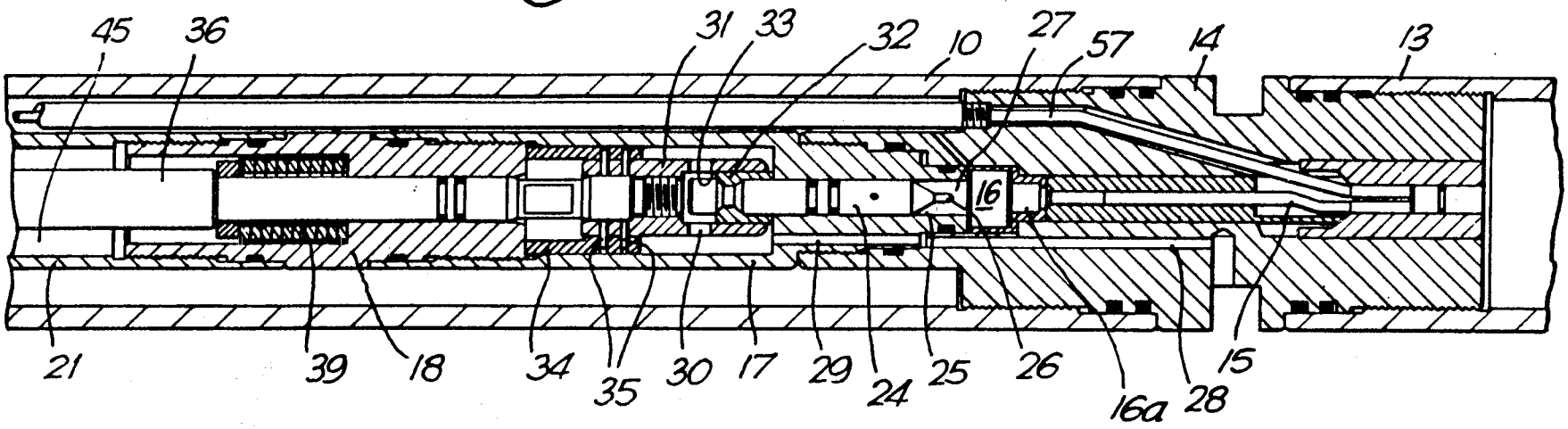

In the drawings, a tool housing 10 is joined at its upper end, i.e. at the left hand of FIG. 1, to the bottom length of a tubing string (not shown) fitted with a ported sub-assembly by a screw thread 11 of an upper outer connector 12. The lower end of the tool 10, i.e. at the right hand of FIG. 3, is joined to a perforating gun assembly 13 by a lower threaded connector 14.

The perforating gun assembly 13 contains a perforating gun (not shown) of known kind, in which an array to be exploded by combination of a boosted primer cord 15 which is itself ignited by a detonator 16 of the kind which detonates on impact. The primer cord 15 and detonator 16 are retained on the axis of and within the lower connector 14. The booster is designated 16*a*.

A co-axial cylinder member 17 is screwed at its lower end to the lower connector 14 and at its upper end to an inner connector 18 which is screwed to the lower end of a piston housing 19. At its upper end the piston housing 19 is connected through a choke housing 20 to an upper reservoir housing 21 which is in turn screwed to an upper connector 22. The reduced diameter upper end portion of the connector 22 is received in the recessed end portion of an upper inner connector 23 which is a sliding fit in the upper outer connector 12. Throughout the apparatus, O-ring seals are used where appropriate.

The detonator 16 is arranged to be fired by a detonator pin 24, slidable in a central bore 25 in the lower end of the cylinder member 17, and having a pointed end 26. The space 27 between the detonator 16 and the detonator pin 24 is at atmospheric pressure, while the left hand (upper) end of the detonator pin 24 is vented to the pressure of the well bore outside the tool 10 by passages 28, 29, 30 through the lower connector 14, the cylinder member 17 and an inner sleeve 31, respectively. The pressure on the detonator pin 24 urges it downwards towards the detonator 16, but such movement is prevented by dogs 32, which engage in a groove in the detonator pin 24 and abut an inner face 33 of the inner sleeve 31. The outer cylindrical face of the sleeve 31 is a sliding fit in a bore of a collar 34 abutting the inner connector 18. The sleeve 31 is secured to the collar 34 by shear pins 35.

A lower central rod 36 is screwed to an upper central tube 40, and a piston 41, slidable in the bore of the piston housing 19, is fastened between the rod 36 and tube 40. The upper central tube 40 is slidable through a central bore of the choke housing 20.

The space within the upper chamber housing 21 between the ends of the choke housing 20 and the upper connector 22 forms an upper reservoir 42 which is divided into an upper part **42*a* and a lower part 42*b* by a floating piston 43. The piston 43 separates well fluid above it from hydraulic oil below it and allows expansion of the latter. The space within the piston housing 19 between the choke housing 20 and the piston 41 forms a middle reservoir 44; and the space between the inner connector 18 and the piston 41 a lower reservoir 45. A passage 46 through the choke housing 20 connecting together the upper reservoir 42 with the middle reservoir 44, has a central choke orifice 47 protected by filters 48 fitted one at each end of the passage 46**.

A filtered passage 49 through the lower rod 36 and a passage 50 through the upper rod 40 connect with a passage 51 in the choke housing 20, thereby permitting communication between the middle reservoir 44 and the lower reservoir 45. A choke orifice 52 smaller than the orifice 47, is provided in the passage 51 and is protected by a filter 53.

A passage 54 through the upper outer connector 12 communicates with a passage 55 through the upper inner connector 23 and thence with an axial bore 56 of the upper connector 22; well pressure is thus freely communicated to the reservoir **42*a***.

A primer cord 57 runs from a position next to a booster at the bottom of the primer cord 15 to a connection at the top of the upper outer connector 12 from which a further length 58 of primer cord leads to a firing head (not shown).

To perforate the casing the tubing conveyed perforating guns are fired by ignition of the detonator 16 through release of the detonator pin 24. This may be achieved by various methods, two of which are now described.

In one method, a packer is set between the well bore casing and a tubing string equipped with a tester valve. Annulus pressure above the packer is increased to open the tester valve, thus communicating lower pressure already obtained under the upper part of the tubing string than the tester valve to the lower part of the tubing string below the tester valve; and thus also in the well bore around the detonating head. This reduction in ambient pressure causes a corresponding reduction in the pressure in the upper part **42*a* of the upper reservoir 42 by virtue of the communication afforded by the passages 54, 55 and the bore 56. The pressure reduction is passed on to reservoir 42*b* through the floating piston 43, causing oil to bleed from the middle reservoir 44 through the passage 46 and choke 47. As a consequence of the volumes of the reservoirs 42, 44, the compressibility and viscosity of the oil therein, the action of the choke 47, and the pressure differential, the pressure in the middle reservoir 44 falls more slowly than well bore pressure, the rate being determined by the above factors. Furthermore, the pressure in the lower reservoir 45 bleeds through the bore 50 and passage 51 even more slowly than that in the middle reservoir 44 because the choke 52 is smaller than the choke 47. Thus, the piston 41 is subject to a pressure differential causing an upward force thereon. The magnitude of the pressure differential slowly rises to a point where the shear pins 35 are sheared so that the piston 41 is urged upwards, drawing the lower rod 36 and the sleeve 31 with it, aided by the spring 39. There is thus also a delay between the time at which the shear pins 35 are sheared and the point at which the detonating piston 24 is released. As the cross-sectional area of the piston 41 is fixed, the shearing force on pins 35** is a function of the pressure differential on the piston.

When the bottom of the sleeve 31 clears the dogs 32, the latter fall away to release the detonator pin 24; the point 26 of the latter then strikes the detonator 16 as the pin 24 is driven by the differential between well bore pressure acting above it and atmospheric pressure on its lower end. Reduction of the tubing pressure may be achieved by running the detonating head with a DST type string and applying pressure to the annulus to open a ball valve to allow communication of the well bore in the region of the tool 10 with a lower hydrostatic pressure above the valve, as previously indicated.

In an alternative method of firing the guns, where it is not desirable or practicable to reduce well bore pressure around the detonating head from ambient, it is possible to obtain detonation by applying additional tubing pressure. Thus, the pressure around the apparatus head and hence in all the reservoirs is increased slowly. The increase in tubing and ambient well bore pressure is then removed, and the apparatus operates as if the well bore pressure had been lowered from its normal value in the manner previously described.

Another method of operation of the detonating head involves the use of nitrogen and the manipulation of various tester and circulating valves in the system, thereby creating the necessary pressure drops required to actuate the detonating head.

In a further method of operation the detonating head is run down the well on a tubing string partly filled with fluid, and equipped with a packer and tester valves. After pressure testing the tubing string with nitrogen, but before bleeding off the nitrogen, the tester valve is opened by the application of annulus pressure which allows the well bore around the detonating head to be pressurized by the nitrogen pressure applied to the tubing string. The tester valve is then closed by bleeding off the annulus, and nitrogen above the tester valve is slowly bled off at the surface, during which time the head is pressurized as previously described. When the tester valve is opened by pressurizing the annulus, the immediate pressure drop around the head causes the guns to be detonated.

The advantage of using gas pressure (for example nitrogen pressure) is that, although more expensive, it is easily removable by venting, whereas a liquid has to be displaced.

If for any reason the detonator 16 fails to go off, the perforating guns may be fired by actuating the firing head at the upper end of the primer cord 58. If the guns fail to detonate, the whole detonating head can be rendered safe by allowing well bore pressure to reach the atmospheric chamber below the detonating pin 24 through the route of the primer cords 58, 57. It will be appreciated that the primer cords 57, 58 burn out when the apparatus works normally.

Preferably a shaped charge is interposed between the detonator or high temperature initiator (HTI) 16 and the top of the booster **16*a* so that if the charge or the HTI 16 fails a metal barrier will not be breached; if the charge and the HTI 16** do detonate then it may be assumed that perforation has occurred. This arrangement prevents the destruction of components any further back.

Although the differential pressure firing system has been described as run above the guns, it may also run below the guns.

Figure 4:
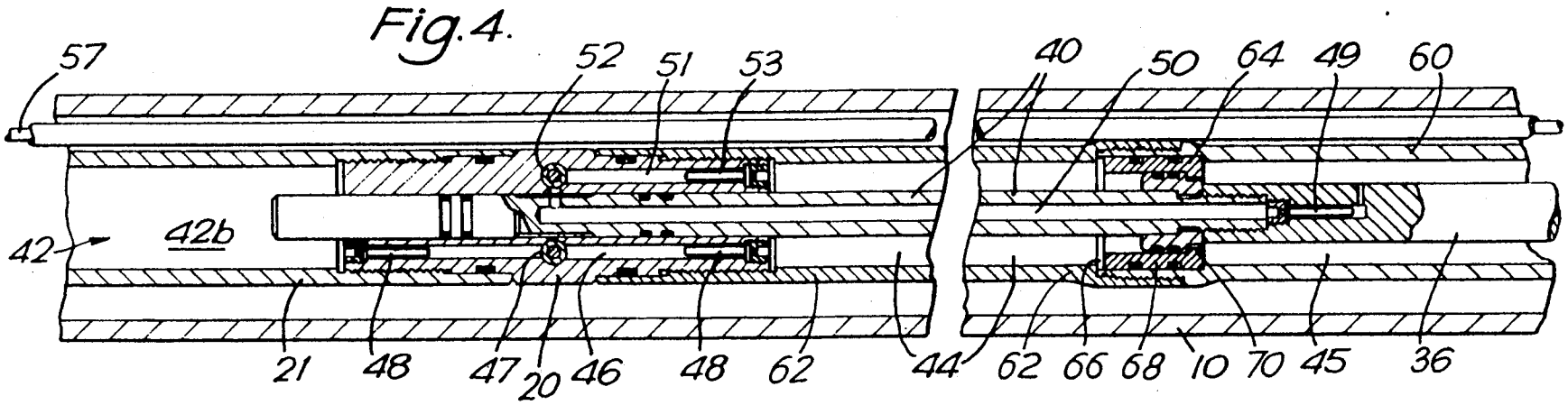
FIG. 4 is a similar section, corresponding to FIG. 2 and showing a modification of the release means.

In the modification of FIG. 4 the piston housing 19 is divided into an upper housing 62 and a lower housing 60, the top of which screws into the bottom of the upper housing 62. The top of the upper housing is internally recessed to accommodate an annular outer piston 64, the upward travel of which is limited by an internal shoulder 66 on the upper housing 62. An inner annular piston 68 is slidably received within the outer piston 64 which resembles the piston 41 in having an internal projection clamped between the lower central rod 36 and the upper central tube 40 so that movement of the inner piston 68 causes corresponding movement of the retaining sleeve 31. Upward movement of the outer piston 64 is transmitted to the inner piston 68 by virtue of the inter-engaging shoulders 70, but subsequent relative upward movement of the inner piston 68 is permitted. Sealing between sliding surfaces is ensured by O-rings in the conventional way.

As the pressure differential across the pistons 64 and 68 increases, a point is reached at which the pistons move together to shear the shear pins 35 (FIG. 3). On shearing the movement of the outer piston 64 is arrested by abutment with the shoulder 66. The length of travel, although short, is adequate to ensure shearing of the pins 35, and, as the overall diameter of the dual piston assembly is greater than that of the piston 41, a greater shearing force is generated for a given pressure differential.

Because only a small amount of the stored energy is used by the piston 64, there is ample energy left to drive the piston 68 sufficiently upwards for the sleeve 31 completely to release the dogs 32. As in the previous embodiment the movement of the rod 36 and sleeve 31 is assisted by the spring 39. However, in applications where a large pressure differential is available, the spring 39 may be dispensed with, and the energy stored in the compressed fluid used as the sole propelling force.

In a modification of the above-described embodiment the system may be used to perforate a tubing or drill pipe string by running it down the string on a slick line, and increasing the pressure in the string to cause detonation.

The advantages afforded by apparatus according to the invention may be summarized as follows:

1) The piston 41 is pressure balanced and there is minimal force on shear pins 35 until the packer is set and a differential pressure created by surface application and/or operating valves in the tubing string. Thus there is no significant pressure differential across the shear pins when running the tool in or out of the hole, and the danger of accidental operation is eliminated.

2) Only a low differential pressure is required to actuate the apparatus and the shear pins may be chosen accordingly; moreover they do not have to withstand a large shearing force as is the case when they maintain a detonating pin against the .difference between well bore and atmospheric pressure, and are subjected to continual stress, as in absolute pressure type tools.

3) Because, when the detonating apparatus is actuated by first increasing the well bore pressure, it takes a considerable period for the lower chamber to equalize, for example 20 to 30 minutes, the apparatus is inherently inert to inadvertent pressure surges in the well. To actuate the apparatus not only must the pressuring up be done at a sufficient pressure for a sufficient time, but the bleeding off must also be performed at a sufficient differential and a sufficient, but much shorter time, say 1 minute. Consequently the apparatus can never be accidentally actuated by the speed at which the tubing string is withdrawn from the well. As the time taken to pressure test a well is very short, no actuation can occur by pressure testing thus facilitating testing procedures, and indeed such testing can be performed when pressuring up. Moreover, the delay between pressure reduction in the tubing string and detonation can ensure that perforation occurs in under-balance conditions.

4) The apparatus may be combined with another or a similar type of detonating apparatus to provide a secondary method of detonation.

5) Because the detonating apparatus works with lower applied pressures and its operation has an inbuilt delay, it is much safer and more reliable to operate than conventional actuating heads.

We claim:

1. Detonating apparatus for detonating a gun for perforating a well bore casing, the apparatus being for suspension down the well, and comprising a detonating pin arranged to be urged, when the apparatus is down said well towards a detonator, restraining means for restraining the pin from movement until detonation is required, .pressure-actuated release means comprising displaceable means arranged for displacement to release the restraining means under the influence of a predetermined differential fluid pressure, and pressure delay means for causing or allowing said predetermined differential fluid pressure developed within the apparatus to build up over a period of time consequent upon reduction in ambient pressure around the apparatus.

2. Apparatus as claimed in claim 1, in which the pressure-actuated release means include a piston and cylinder assembly, the piston having first and second fluid reservoirs on respective sides thereof within the cylinder, and movement of the piston being caused by achievement of said differential pressure between the reservoirs.

3. Apparatus as claimed in claim 2, in which the pressure control means are arranged to allow fluid in the second reservoir to bleed through a restrictor orifice into a third, variable-volume reservoir.

4. Apparatus as claimed in claim 3, in which the first and second reservoirs are connected by a smaller restrictor orifice which allows fluid to flow from the second reservoir into the first reservoir to allow it to be pressurized, and to flow from the first to the second reservoir while fluid is flowing from the second to the third reservoir, but at a slower rate than the rate of flow from the second to third reservoir.

5. Apparatus as claimed in claim 3, in which the third, variable volume reservoir comprises a cylinder and a free-floating piston, the position of one face of which within the cylinder defines the volume of the reservoir, and the other face of which is exposed to well bore pressure.

6. Apparatus as claimed in claim 1, in which the displaceable means are fixed against movement by shear means which are sheared when detonation is required by shear forces generated when said predetermined differential pressure is reached.

7. Apparatus as claimed in claim 1, in which the displaceable means are resiliently loaded to assist subsequent movement of said means to a position in which the restraining means are released.

8. Apparatus as claimed in claim 4, in which the third, variable volume reservoir comprises a cylinder and a free-floating piston, the position of one face of which within the cylinder defines the volume of the reservoir, and the other face of which is exposed to.sell bore pressure.

9. Apparatus as claimed in claim 2, in which the displaceable means are fixed against movement by shear means which are sheared when detonation is required by shear forces generated when said predetermined differential pressure is reached.

10. Apparatus as claimed in claim 3, in which the displaceable means are fixed against movement by shear means which are sheared when detonation is required by shear forces generated when said predetermined differential pressure is reached.

11. Apparatus as claimed in claim 4, in which the displaceable means are fixed against movement by shear means which are sheared when detonation is required by shear forces generated when said predetermined differential pressure is reached.

12. Apparatus as claimed in claim 5, in which the displaceable means are fixed against movement by shear means which are sheared when detonation is required by shear force generated when said predetermined differential pressure is reached.

13. Apparatus as claimed in claim 1, in which the pressure-actuated release means include a cylinder, and first and second pistons arranged for sliding movement therewithin, the pistons having first and second fluid reservoirs on respective sides thereof within the cylinder, and movement of said pistons being caused by achievement of said differential pressure between the reservoirs, and in which the displaceable means are fixed against movement by shear means, the travel of said first piston being limited to a distance sufficient to allow shearing of the shear means when detonation is required, by shear forces generated when said differential pressure is reached, and the subsequent travel of the second piston being sufficient to ensure that the consequent displacement of the displacement means is adequate to release the restraining means fully.

14. Apparatus as claimed in claim 13, in which the pressure control means are arranged to allow fluid in the second reservoir to bleed through a restrictor orifice into a third, variable-volume reservoir.

15. Apparatus as claimed in claim 14, in which the first and second reservoirs are connected by a smaller restrictor orifice which allows fluid to flow from the second reservoir into the first reservoir to allow it to be pressurized, and to flow from the first to the second reservoir while fluid is flowing from the second to the third reservoir, but at a slower rate than the rate of flow from the second to third reservoir.

16. Apparatus as claimed in claim 14, in which the third, variable volume reservoir comprises a cylinder and a free-floating piston, the position of one face of which within the cylinder defines the volume of the reservoir, and the other face of which is exposed to well bore pressure.

17. Apparatus as claimed in claim 13, in which the displaceable means are fixed against movement by shear means which are sheared when detonation is required by shear forces generated when said predetermined differential pressure is reached.

18. A method of actuating a detonating apparatus for detonating a gun for perforating a well bore casing, the apparatus being suspended on a tubing string lowered down the well, and comprising a detonating pin arranged to be urged towards a detonator, restraining means for restraining the pin from movement until detonation is required, pressure-actuated release means comprising displaceable means arranged for displacement to release the restraining means under the influence of a predetermined differential fluid pressure, and pressure delay means for causing or allowing said predetermined differential fluid pressure developed within the apparatus to build up over a period of time, consequent upon reduction in ambient pressure around the apparatus, in which the pressure-actuated release means include a piston and cylinder assembly, the piston having first and second fluid reservoirs on respective sides thereof within the cylinder, and movement of the piston being caused by achievement of said differential pressure between the reservoirs, said method comprising the steps of allowing the fluid pressure in the first and second reservoirs to equal well bore pressure, isolating the well bore from the tubing string, and reducing the pressure of the fluid in the tubing string until actuation has occurred.

19. A method of actuating a detonating apparatus for detonating a gun for perforating a well bore casing, the apparatus being suspended on a tubing string lowered down the well, and comprising a detonating pin arranged to be urged towards a detonator, restraining means for restraining the pin from movement until detonation is required, pressure-actuated release means comprising displacement means arranged for displacement to release the restraining means under the influence of a predetermined differential fluid pressure, and pressure delay means for causing or allowing said predetermined differential fluid pressure developed within the apparatus to build up over a period of time, consequent upon reduction in ambient pressure around the apparatus, in which the pressure-actuated release means include a piston and cylinder assembly, the piston having first and second fluid reservoirs on respective sides thereof within the cylinder, and movement of the piston being caused by achievement of said differential pressure between the reservoirs, said method comprising the steps of isolating the well bore from the tubing string, increasing the pressure in the tubing string above well bore pressure, allowing the pressure in the first and second reservoirs to reach the increased value, and then reducing the pressure of the fluid in the tubing string until actuation has occurred.

20. A method as claimed in claim 19, wherein the pressure in the tubing string is increased by pressurizing with gas.

* * * * *